United States Patent [19]

Yamato et al.

[11] Patent Number: 4,523,571

[45] Date of Patent: Jun. 18, 1985

[54] FUEL SUPPLY CONTROL METHOD FOR INTERNAL COMBUSTION ENGINES AT ACCELERATION

[75] Inventors: Akihiro Yamato, Shiki; Noriyuki Kishi, Itabashi, both of Japan

[73] Assignee: Honda Giken Kogyo Kabushiki Kaisha, Tokyo, Japan

[21] Appl. No.: 503,758

[22] Filed: Jun. 13, 1983

[30] Foreign Application Priority Data

Jun. 16, 1982 [JP] Japan ..... 57-103408

[51] Int. Cl.[3] ..... F02M 51/02

[52] U.S. Cl. ..... 123/492; 123/493

[58] Field of Search ..... 123/492, 493

[56] References Cited

U.S. PATENT DOCUMENTS

| | | | |
|---|---|---|---|
| 3,661,126 | 5/1972 | Baxendale | 123/492 |
| 3,946,704 | 3/1976 | Monpetit | 123/492 |
| 3,983,851 | 10/1976 | Hoshi | 123/492 |
| 4,227,490 | 10/1980 | Kobayashi et al. | 123/492 |
| 4,240,383 | 12/1980 | Horbelt et al. | 123/492 |
| 4,389,997 | 6/1983 | Nakano et al. | 123/492 |
| 4,440,136 | 4/1984 | Denz et al. | 123/492 X |

*Primary Examiner*—Tony M. Argenbright

*Attorney, Agent, or Firm*—Arthur L. Lessler

[57] ABSTRACT

A method for electronically controlling a fuel injection device which injects fuel into an internal combustion engine, so as to supply a required quantity of fuel to the engine when it is accelerating. It is determined whether or not the engine is operating in a predetermined accelerating condition or in a predetermined decelerating condition, in synchronism with generation of pulses of a control signal having a constant pulse repetition period and being independent of rotation of the engine. When the engine is determined to be in the predetermined accelerating condition, fuel injections are consecutively effected a predetermined number of times in synchronism with generation of pulses of the above control pulse. The above consecutive fuel injections are continued until the above predetermined number of times are reached, so long as the engine is determined not to be in the above predetermined decelerating condition. Preferably, the value of the above predetermined number of times of consecutive fuel injections is set in dependence on the temperature of the engine, and the quantity of fuel to be injected per each of the above predetermined number of times is set in dependence on the rate of change of the throttle valve opening.

17 Claims, 12 Drawing Figures

FUEL SUPPLY CONTROL METHOD FOR INTERNAL COMBUSTION ENGINES AT ACCELERATION

BACKGROUND OF THE INVENTION

This invention relates to a fuel supply control method for electronically controlling the quantity of fuel being supplied to an internal combustion engine, and more particularly to a fuel supply control method of this kind, which is adapted to supply fuel to the engine in an amount appropriate to the magnitude of acceleration of the engine as desired by the driver, thereby improving the driveability of the engine at acceleration.

A fuel supply control system adapted for use with an internal combustion engine, particularly a gasoline engine has been proposed e.g. by Japanese Patent Provisional Publication (Kokai) No. 57-137633, which is adapted to determine the valve opening period of a fuel injection device for control of the fuel injection quantity, i.e. the air/fuel ratio of an air/fuel mixture being supplied to the engine, by first determining a basic value of the valve opening period as a function of engine rpm and intake pipe absolute pressure and then adding to and/or multiplying same by constants and/or coefficients being functions of engine rpm, intake pipe absolute pressure, engine cooling water temperature, throttle valve opening, exhaust gas ingredient concentration (oxygen concentration), etc., by electronic computing means.

According to this proposed fuel supply control system, the calculations of the valve opening period, i.e. fuel injection quantity and the operation of the fuel injection device are executed in synchronism with a top-dead-center (TDC) signal which is generated synchronously with rotation of the engine. When the magnitude of acceleration required for the engine to perform exceeds a predetermined value, such as at sudden acceleration, in addition to accelerating fuel quantity increase according to the above control synchronous with the TDC signal, another accelerating fuel quantity increase is applied at the same time, which is executed in synchronism with a control signal having a certain constant pulse repetition period and being independent of the TDC signal (asynchronous accelerating fuel quantity increase control), so as to make up for a shortage in the increasing fuel amount obtained by the TDC signal-synchronized control at acceleration of the engine, thereby enhancing the output characteristic of the engine.

According to this asynchronous accelerating fuel quantity increase control, the engine is determined to be in an accelerating condition wherein the same control is to be carried out, if the rate of change of the throttle valve opening, which is detected upon generation of each pulse of the above control signal with a constant pulse repetition period (hereinafter called "asynchronous control signal"), exceeds a predetermined value while the valve opening is increasing. Thus, only when the rate of change of the throttle valve opening is larger than the above predetermined value, the asynchronous accelerating fuel quantity increase control is effected. However, in suddenly snapping the engine or in stepping on the accelerator pedal to open the throttle valve to its maximum opening, the valve opening of the throttle valve can still assume a large value in the vicinity of the maximum opening position even when the rate of change of the throttle valve opening which has once been increased by the stepping-on of the accelerator pedal is afterwards decreased below the above predetermined value. On such an occasion, if the asynchronous accelerating fuel increase control is interrupted simultaneously when the rate of change of the throttle valve opening is decreased below the above predetermined value, a required increase in the engine output as desired by the driver cannot be achieved, thereby deteriorating the driveability of the engine.

SUMMARY OF THE INVENTION

It is the object of the invention to provide a fuel supply control method for an internal combustion engine at acceleration, which is adapted to supply fuel to the engine in an amount appropriate to an operating condition of the engine at acceleration so as to achieve a required increase in the engine output as desired by the driver, to thereby improve the driveability of the engine at acceleration.

According to the invention, there is provided a method for electronically controlling a fuel injection device for injecting fuel into an internal combustion engine, so as to supply a required quantity of fuel to the engine when it is accelerating, the method being characterized by comprising the following steps: (1) determining whether or not the engine is operating in a predetermined accelerating condition, each time a pulse of a control signal is generated with a predetermined constant pulse repetition period and independently of rotation of the engine; (2) determining whether or not the engine is operating in a predetermined decelerating condition each time a pulse of the above control signal is generated; (3) actuating the above fuel injection device to effect fuel injections consecutively into the engine a predetermined number of times in synchronism with generation of pulses of the above control signal, when it is determined in the step (1) that the engine is operating in the above predetermined accelerating condition; and (4) interrupting the fuel injections of the step (3), when it is determined in the step (2) that the engine is operating in the above predetermined decelerating condition before the above predetermined number of times of consecutive fuel injections are completed, while continuing the fuel injections of the step (3) until the above predetermined number of times are reached, so long as it is determined in the step (2) that the engine is not operating in the above predetermined decelerating condition.

Even when the engine is determined to be operating in a normal operating condition other than the above predetermined accelerating and decelerating conditions before the predetermined number of times of consecutive fuel injections of the step (3) are completed, the same fuel injections are continued until the predetermined number of times are reached.

Preferably, the quantity of fuel to be injected per each of the above predetermined number of times in the step (3) is set in dependence on the magnitude of acceleration required for the engine to perform. Also preferably, if the rate of change of the valve opening of a throttle valve arranged in an intake passage of the engine is larger than a first predetermined value while the valve opening is increasing, the engine is determined to be operating in the above predetermined accelerating condition, while if the rate of change of the valve opening is larger than a second predetermined value while the valve opening is decreasing, the engine is determined to be operating in the above predetermined decelerating condition. The value of the predetermined number of times of consecutive fuel injections of the step (3) is set in dependence on the temperature of the engine.

Further, preferably, the method according to the invention further includes the steps of determining whether or not the engine is in an operating condition requiring cutting off the fuel supply to the engine, as well as whether or not the engine is in an operating condition requiring interruption of the cutting-off of the fuel supply, determining whether or not a predetermined period of time has elapsed after the cutting-ff of the fuel supply has been interrupted, when the engine is determined to be in the above operating condition requiring interruption of the cutting-off of the fuel supply, and setting the value of the predetermined number of times of consecutive fuel injections of the step (3) to different values between before the lapse of the predetermined period of time and after the lapse of same. Preferably, it is set to a fewer value before the lapse of the predetermined period of time than that after the lapse of same.

The above and other objects, features and advantages of the invention will be more apparent from the ensuing detailed description taken in conjunction with the accompanying drawings.

DETAILED DESCRIPTION

The method according to the invention will be described with reference to the drawings.

Figure 1:
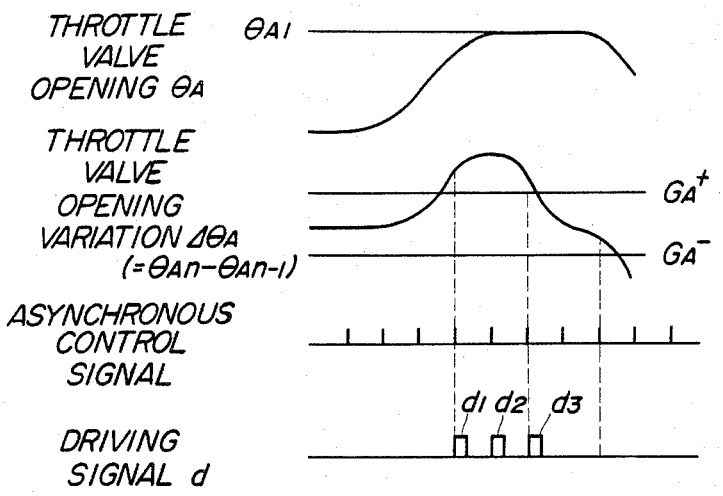
FIG. 1 (PRIOR ART)
FIG. 1 is a timing chart showing the relationship between the rate of change $\Delta\theta A$ of the throttle valve opening and generation of driving signals for fuel injection valves, according to a conventional fuel supply control method for an internal combustion engine at acceleration.

Referring first to FIG. 1, there is shown a timing chart showing the relationship between the rate of change $\Delta\theta A$ of the throttle valve opening and generation of driving signals for fuel injection valves, which is given for explanation of a typical conventional fuel supply control method. According to the illustrated method, a value of the throttle valve opening $\theta A$ is detected each time a pulse of the asynchronous control signal SA is generated, and the difference between a value $\theta An$ of the throttle valve opening detected and read upon generation of a present pulse of the asynchronous control signal and a value $\theta An\text{-}1$ of the same valve opening detected and read upon generation of the preceding pulse of the same control signal is determined as a rate of change or variation $\Delta\theta A$ of the throttle valve opening. A determination as to whether or not the variation $\Delta\theta A$ is larger than a predetermined value $GA+$ is made upon generation of each pulse of the asynchronous control signal. Only when the relationship of $\Delta\theta A > GA+$ stands, driving pulses $d_1$–$d_3$ are outputted for actuating the fuel injection valves. According to this conventional method, since the accelerating fuel increases is effected only on the basis of the variation $\Delta\theta A$ of the throttle valve opening, such driving signals are not outputted when the variation $\Delta\theta A$ is reduced below the above predetermined value $GA+$ on some occasions such as in suddenly snapping the engine or when the accelerator pedal is stepped on to open the throttle valve to its maximum opening, resulting in interruption of the accelerating fuel increase. However, even on such occasions, the throttle valve opening $\theta A$ can still assume a large value $\theta A1$, e.g. a value in the vicinity of the maximum opening position. Therefore, interruption of the accelerating fuel increase on such occasions will impede achieving a degree of acceleration as desired by the driver or obtaining a required increase in the engine output, deteriorating the driveability of the engine.

Figure 2:
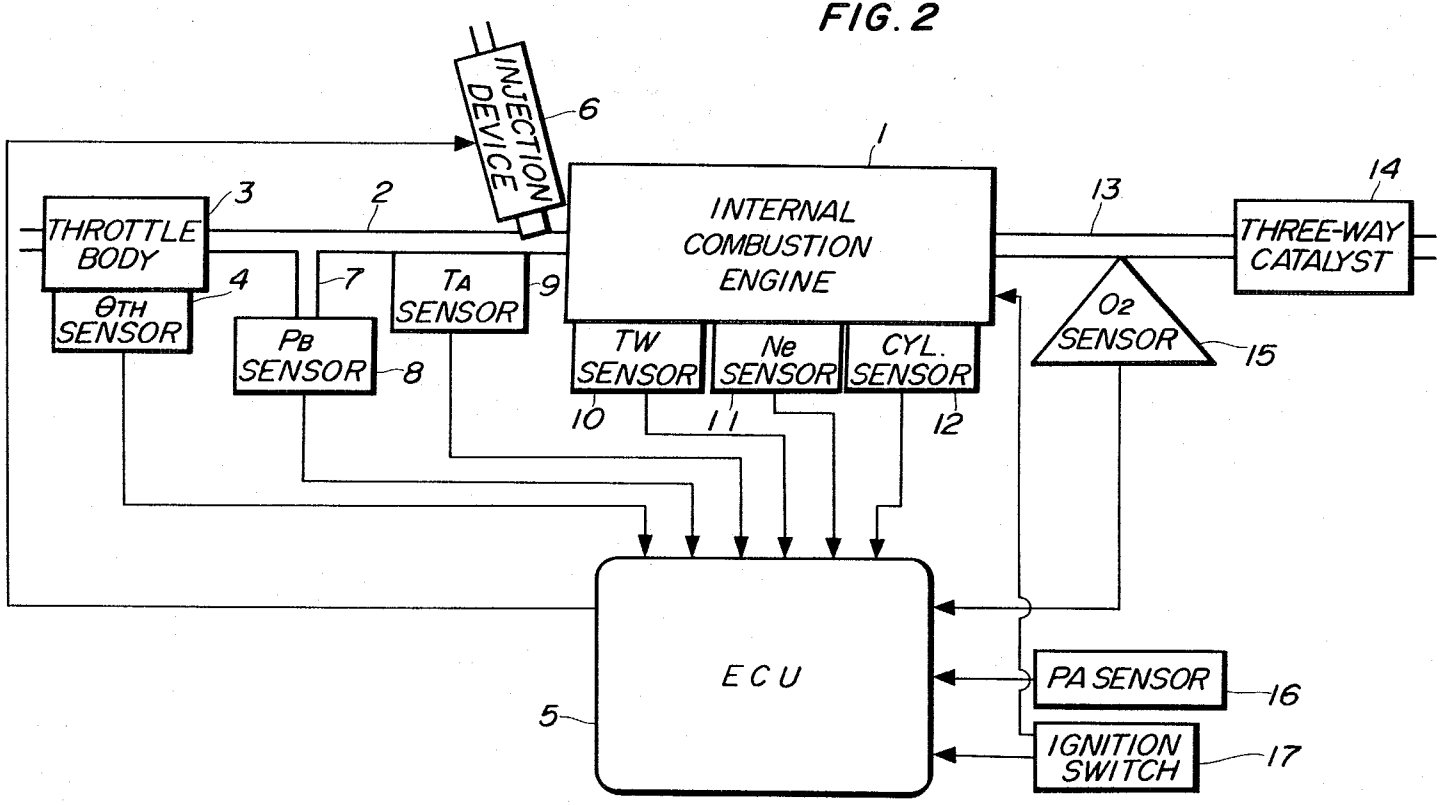
FIG. 2 is a block diagram illustrating the whole arrangement of a fuel supply control system to which is applicable the method according to the present invention.

Referring next to FIG. 2, there is illustrated the whole arrangement of a fuel supply control system for internal combustion engines, to which the method according to the invention is applicable. Reference numeral 1 designates an internal combustion engine which may be a four-cylinder type, for instance. An intake pipe 2 is connected to the engine 1, in which is arranged a throttle valve 3, which in turn is coupled to a throttle valve opening ($\theta$TH) sensor 4 for detecting its valve opening and converting same into an electrical signal which is supplied to an electronic control unit (hereinafter called "ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure (PB) sensor 8 communicates through a conduit 7 with the interior of the intake pipe at a location immediately downstream of the throttle valve 3. The absolute pressure (PB) sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure (PB) sensor 8 and also electrically connected to the ECU 5 for supplying thereto an electrical signal indicative of detected intake air temperature.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational angle position sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA) and an ignition switch 17 for actuating the ignition device, not shown, of the engine 1, respectively, for supplying the ECU 5 with an electrical signal indicative of detected atmospheric pressure and an electrical signal indicative of the on-off positions of the ignition switch.

The ECU 5 operates in response to various engine operation parameter signals as stated above, to calculate the fuel injection period of the fuel injection valves 6, in accordance with operating conditions of the engine, and supplies corresponding driving signals to the fuel injection valves 6.

Figure 3:
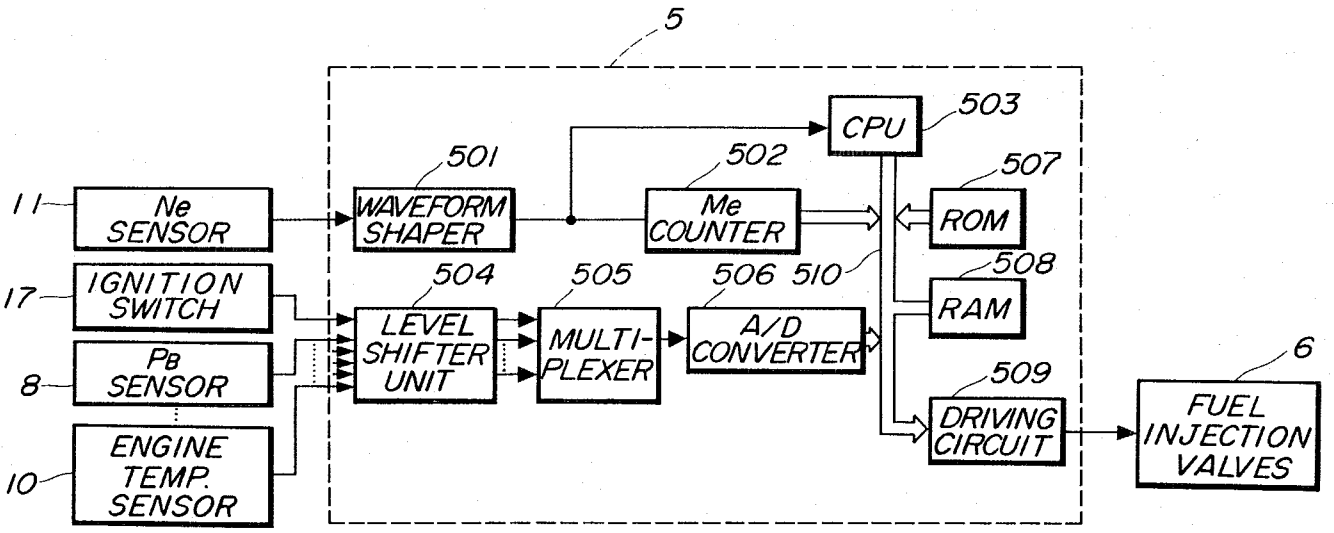
FIG. 3 is a circuit diagram showing an electrical circuit within the electronic control unit (ECU) in FIG. 2.

FIG. 3 shows a circuit configuration within the ECU 5 in FIG. 2. An output signal from the Ne sensor 11 is applied to a waveform shaper 501, wherein it has its pulse waveform shaped, and supplied to a central processing unit (hereinafter called "CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position sensor 11, and therefore its counted value Me corresponds to the reciprocal of the actual engine rpm Ne. The Me value counter 502 supplies the counted value Me to the CPU 503 via a data bus 510.

The respective output signals from the intake pipe absolute pressure (PB) sensor 8, the engine coolant temperature (TW) sensor 10, the ignition switch 17, etc. have their voltage levels successively shifted to a predetermined voltage level by a level shifter unit 504 and applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "ROM") 507, a radom access memory (hereinafter called "RAM") 508 and a driving circuit 509. The RAM 508 temporarily stores various calculated values from the CPU 503, while the ROM 507 stores a control program executed within the CPU 503 as well as various tables and maps, various correction coefficients and constants, etc. The CPU 503 executes the control program stored in the ROM 507 to calculate the fuel injection period for the fuel injection valves 6 in response to the various engine operation parameter signals, and supplies the calculated value of fuel injection period to the driving circuit 509 through the data bus 510. The driving circuit 509 supplies driving signals corresponding to the above calculated value to the fuel injection valves 6 to drive same.

Next, the fuel quantity control operation of the fuel supply control control system arranged as above will now be described in detail with reference to FIGS. 2 and 3 referred to hereinabove, as well as FIG. 4 through FIG. 12.

Figure 4:
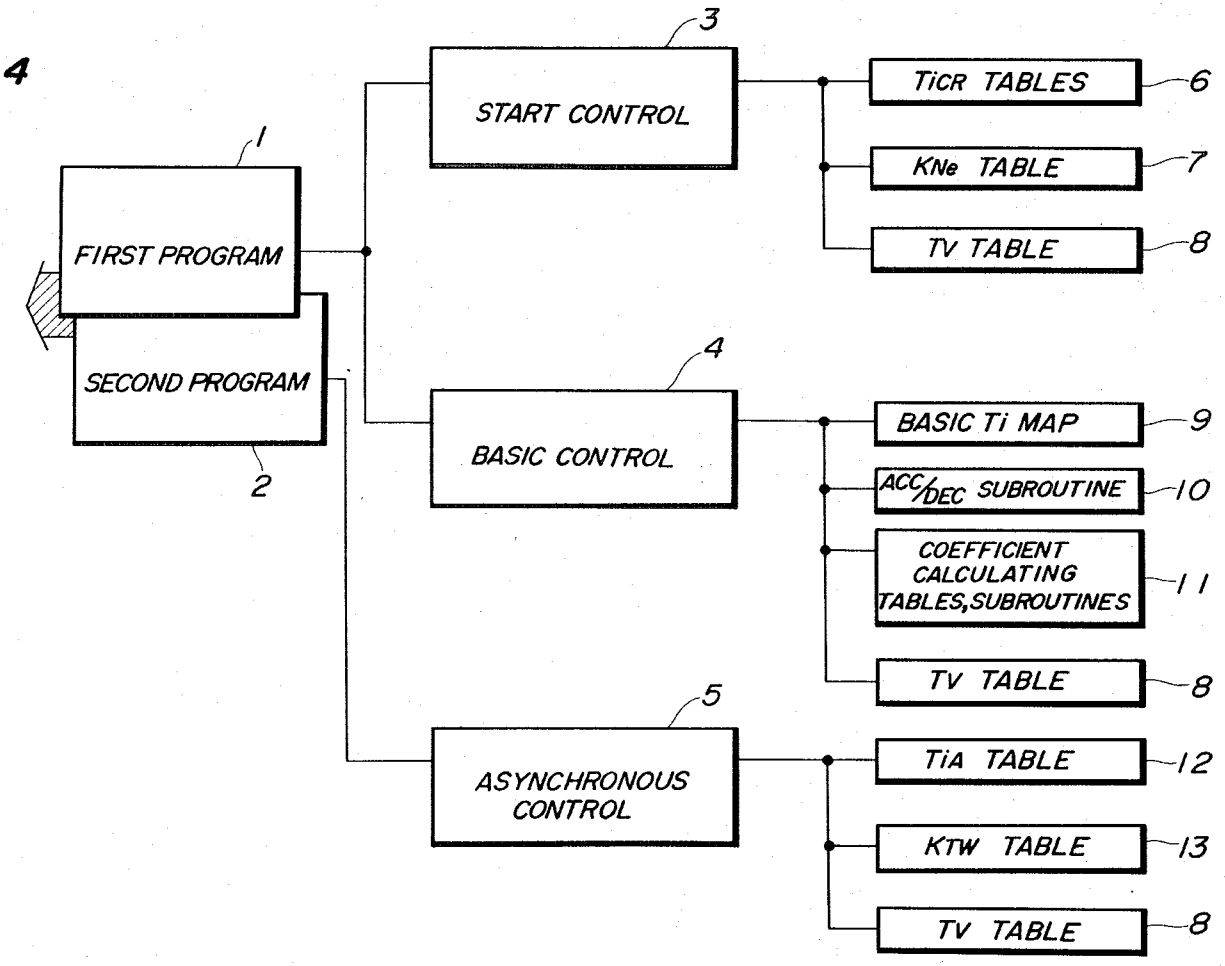
FIG. 4 is a block diagram illustrating a program for control of the valve opening period of the fuel injection valves, which are operated by the ECU in FIG. 2.

Referring first to FIG. 4, there is illustrated a block diagram showing the whole program for control of the valve opening period of the fuel injection valves 6, which is executed by the ECU 5 in FIG. 2. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal, i.e. rotation of the engine.

In the start control subroutine 3, the valve opening period is determined by the following basic equations:

$$TOUT = TiCR \times KNe + TV \quad (1)$$

where TiCR represents a basic value of the valve opening period for the fuel injection valves 6, which is determined from a TiCR table 6, KNe represents a correction coefficient applicable at the start of the engine, which is variable as a function of engine rpm Ne and determined from a KNe table 7, and TV represents a correction value for increasing and decreasing the valve opening period in response to changes in the output voltage of the supply power battery, which is determined from a TV table 8.

The basic equation for determining the value of TOUT applicable to the basic control subroutine 4 are as follows:

$$TOUT = (Ti - TDEC) \times (KTA \times KTW \times KAFC \times KPA \times KAST \times KWOT \times KO_2 \times KLS) + TACC \times (KTA \times KTWT \times KAFC) + TV \quad (2)$$

where Ti represents a basic value of the valve opening period for the fuel injeciton valves 6, and is determined from a basic Ti map 9, TDEC, TACC represent correction values applicable, respectively, at engine deceleration and at engine acceleration and are determined by acceleration and deceleration subroutines 10, and KTA, KTW, etc. represent correction coefficients which are determined by their respective tables and/or subroutines 11. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ concentration-responsive feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometeric" and means a stoichiometric or theoretical air/fuel ratio of the mixture.

On the other hand, the valve opening period TMA for the fuel injection valves 6 which is applicable in asynchronism with the TDC signal is determined by the following equation:

$$TMA = TiA \times KTWT \times KAST + TV \quad (3)$$

where TiA represents a TDC signal-asynchronous fuel increasing basic value applicable at engine acceleration and in asynchronism with the TDC signal. This TiA value is determined from a TiA table 12. KTWT is defined as a fuel increasing coefficient applicable at and after TDC signal-synchronous accelerating control as well as at TDC signal-asynchronous accelerating control, and is calculated from a value of the aforementioned water temperature-dependent fuel increasing coefficient KTW obtained from the table 13.

Figure 5:
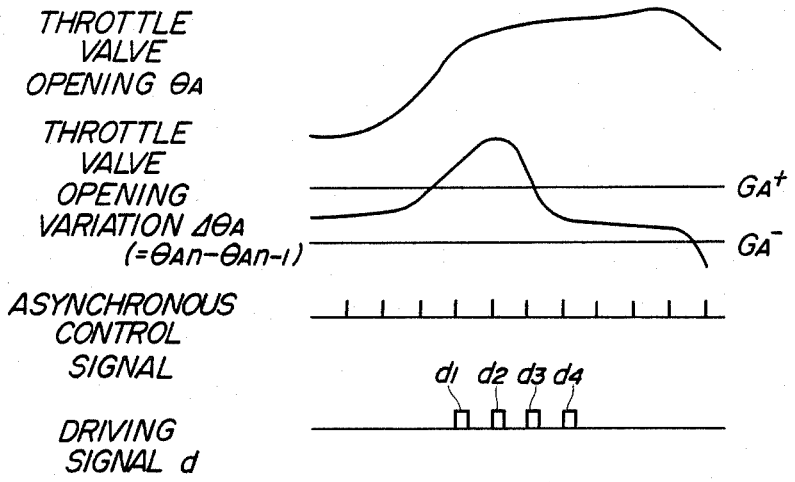
FIG. 5 is a timing chart showing the relationship between the rate of change $\Delta\theta A$ of the throttle valve opening and generation of driving signals for fuel injection valves, according to the fuel supply control method of the present invention.

Among the above described methods of the valve opening period control, the engine rotation-asynchronous accelerating control according to the invention will now be described in detail. Referring to FIG. 5 showing a flow chart of the method of the invention, first, a value of the throttle valve opening $\theta A$ is detected and read each time a pulse of the asynchronous control signal SA having a constant pulse repetition period is generated independently of rotation of the engine, and the difference between a value $\theta An$ of the throttle valve opening read upon generation of a present pulse of the control signal SA and a value $\theta An\text{-}1$ of same read upon generation of the preceding pulse of the same control signal is determined as a variation $\Delta\theta A$. It is then determined whether or not the variation $\Delta\theta A$ is larger than the aforementioned predetermined value $GA^+$ each time a pulse of the asynchronous control signal SA is generated. When the relationship of $\Delta\theta A > GA^+$ stands, driving signals d for each of the fuel injection valves 6 are outputted upon generation of a pulse of the asynchronous control signal SA which is generated immediately after the above relationship has been fulfilled. The above-mentioned control manner is substantially the same as that described previously with reference to FIG. 1. According to the present invention, even when the above throttle valve opening variation $\Delta\theta A$ becomes equal to or smaller than the predetermined value $GA^+$ while the valve opening is increasing, that is, even when the relationship of $\Delta\theta A > GA^+$ stands, the outputting of the driving signals d is continued until a predetermined number of such signals are outputted, so long as the variation $\Delta\theta A$ remains larger than or equal to a predetermined negative value $GA^-$ for determination of a decelerating condition of the engine while the valve opening is decreasing. In the example of FIG. 5, it will be noted that after the variation $\Delta\theta A$ has become larger than the predetermined value $GA^+$, the outputting of the driving pulses d is started, and this outputting is continued without being interrupted even after the variation $\Delta\theta A$ has become smaller than the predetermined value $GA^+$, and then, once the predetermined number of such driving pulses, e.g. four pulses $d_1$–$d_4$ as shown, have been outputted, no further such driving pulses are outputted thereafter. By controlling the fuel injection in this manner, in sudden acceleration of the engine, particularly in sudden snapping or in a wide-open-throttle operation, a required increase in the engine output is easily obtainable, preventing deterioration of the driveability of the engine. Further, according to an embodiment of the invention, if the relationship of $\Delta\theta A > GA^+$ again stands after the above predetermined number of driving pulses d have been outputted, the same predetermined number of further driving pulses d are again outputted. However, according to a further embodiment of the invention hereinafter described, outputting of such next group of the predetermined number of driving pulses d is suspended until a first pulse of the TDC signal is generated immediately after completion of the outputting of the first group of the predetermined number of driving pulses d. This manner of outputting the driving signals according to the further embodiment can prevent injection of an excessive amount of fuel into the engine which would otherwise be caused by repeatedly stepping on the accelerator pedal many times immediately before or upon the start of the engine.

Figure 6:
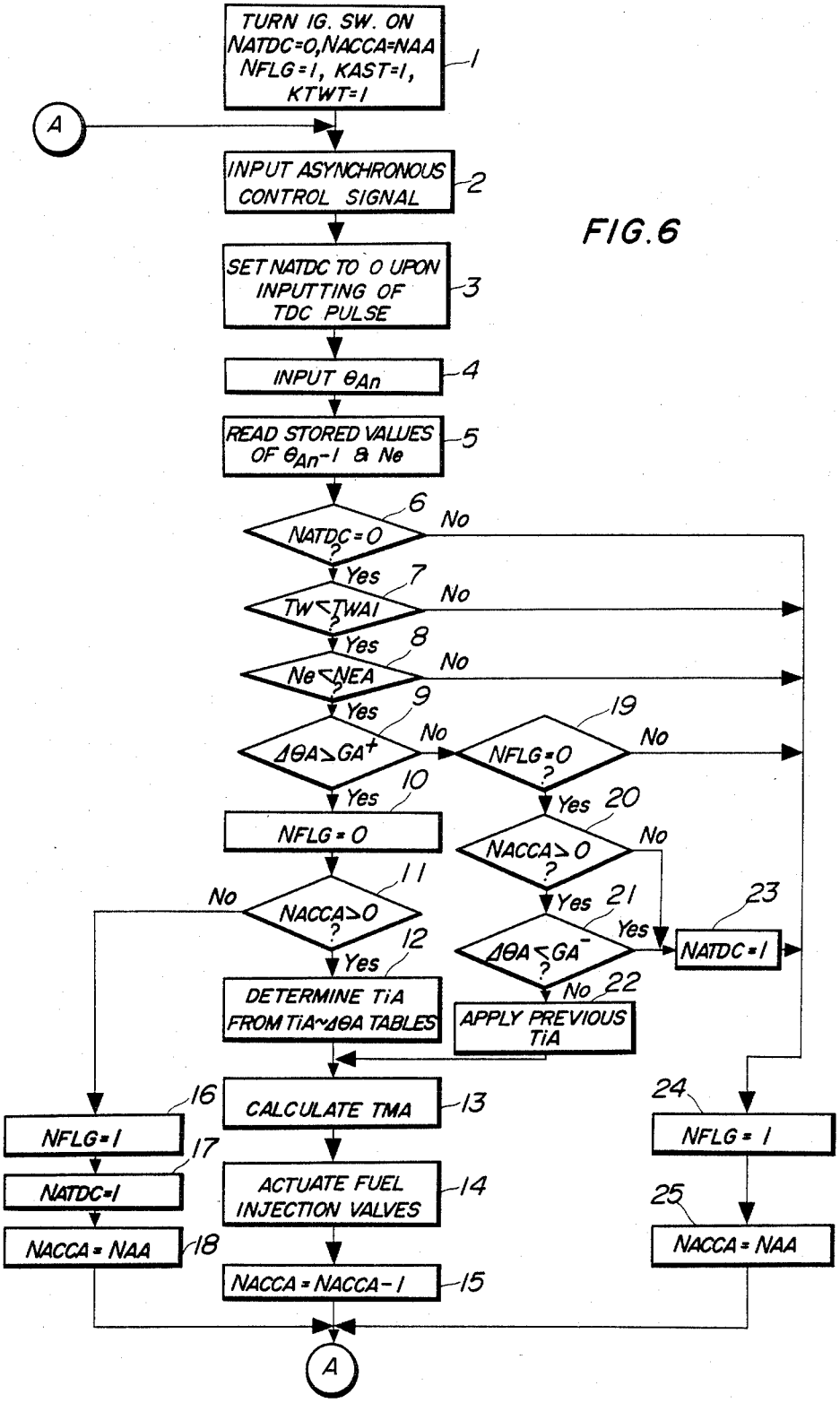
FIG. 6 is a flow chart showing a subroutine of the engine rotation-asynchronous accelerating control according to the invention.
Figure 7:
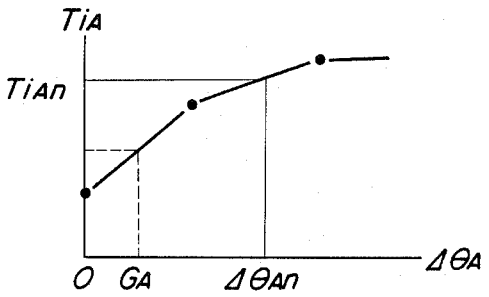
FIG. 7 is a graph showing a table of the relationship between the rate of change $\Delta\theta A$ of the throttle valve opening and a basic value of fuel increment TiA according to the engine rotation-asynchronous accelerating control.

FIG. 6 shows a flow chart of a subroutine for performing the asynchronous accelerating control according to a first embodiment of the invention. At the step 1, a transition in the position of the ignition switch 17 in FIG. 2 is detected from the off position (open position)

to the on position (closed position), and at the same time, the value of a flag signal NATDC is set to 0, and a second flag signal NFLG to 1, respectively. These flag signals NATDC, NFLG indicate whether or not the engine is in a condition wherein the asynchronous accelerating control should be effected. The signal NATDC is set to 0 when the ignition switch 17 is turned on, as well as each time a pulse of the TDC signal is inputted to the ECU 5, to indicate that pulses of the driving signal for the fuel injection valves can be outputted according to the asynchronous accelerating control. On the other hand, it is set to 1 upon inputting of a pulse of the asynchronous control signal immediately after the aforementioned predetermined number of fuel increasing pulses or pulses of the driving signal have been outputted, to prohibit further outputting of pulses of the driving signal. The flag signal NFLG is set to 0 while the engine is in a predetermined condition wherein the asynchronous accelerating control should be effected, and set to 1 while the engine is in other conditions. Further, when the ignition switch 17 is turned on, the number of pulses NACCA indicative of the number of pulses of the driving signal that remain to be outputted is set to an initial value (e.g. 4), and simultaneously the values of the correction coefficients KAST, KTWT are both set to 1. Then, pulses of the asynchronous control signal are inputted to a corresponding counter in the ECU 5, at the step 2. The pulse separation of this asynchronous control signal is set to a value within a range of 10–50 ms. Then, each time a pulse of the TDC signal is inputted to the ECU 5, the value of the above flag signal NATDC is set to 0, at the step 3. Further, each time a pulse of the asynchronous control signal is inputted to the counter, the value of the throttle valve opening $\theta$An is read into a corresponding register in the ECU 5, at the step 4. A value $\theta$An-1 of the throttle valve opening and a value of the engine rpm Ne detected upon inputting of the preceding pulse of the asynchronous control pulse and stored in the above register are read from the respective registers, at the step 5. Then, whether or not the aforementioned flag signal NATDC assumes a value of 0 is determined at the step 6. If the answer is yes, it is determined at the step 7 whether or not the engine cooling water temperature TW is lower than a predetermined value TWA1 (e.g. 70° C.). When the temperature of the engine is high, good combustion takes place within the engine cylinders, permitting stable operation of the engine even without an appreciable amount of increase of the fuel supply quantity to the engine, and also permitting application of a fuel increment TACC according to the TDC signal-synchronized control alone to suffice at acceleration of the engine, even at sudden acceleration. Therefore, if the engine cooling water temperature TW is above the predetermined value TWA1, the asynchronous accelerating control is not effected according to the invention. If the engine water temperature TW is found to be lower than the predetermined value TWA1 at the step 7, it is then determined at the step 8 whether or not the engine speed Ne is lower than a predetermined value of rpm NEA (e.g. 2,800 rpm) for determination of fulfillment of the asynchronous accelerating control condition. As the engine speed Ne becomes higher, the pulse separation or pulse interval of the TDC signal becomes shorter, and accordingly the aforementioned acceleration fuel increment TACC alone according to the synchronous control alone will suffice to obtain satisfactory responsiveness of fuel increasing control to acceleration of the engine. Therefore, when the engine speed Ne exceeds the above predetermined value of rpm NEA, the fuel increasing action according to the asynchronous accelerating control is prohibited. If any of the answers to the questions at the above steps 6 to 8 is negative, execution of the asynchronous accelerating control is prohibited. That is, the value of the flag signal NFLG is set to 1 at the step 24, and the value of the pulse number NACCA is set to the initial value NAA at the step 25. If at the step 8 it is determined that the engine speed Ne is lower than the predetermined value of rpm NEA, it is determined at the step 9 whether or not the difference or variation $\Delta\theta$A between the value $\theta$An of the throttle valve opening in the present loop and the value $\theta$An-1 of same in the preceding loop, read at the step 4 is larger than the aforementioned predetermined value GA+ (e.g. 20°/sec). If the answer is affirmative, the value of the flag signal NFLG is set to 0 at the step 10 and it is determined at the step 11 whether or not the stored value of the pulse number NACCA is larger than 0. If the answer is yes, a basic value TiA of the asynchronous acceleration fuel increment is determined from a table, at the step 12. FIG. 7 shows an example of such table plotting the relationship between the rate of change $\Delta\theta$A and the basic value TiA of the asynchronous acceleration fuel increment. As shown in this table, the basic value TiA is increased up to a constant value with an increase in the throttle valve opening variation $\Delta\theta$A or the magnitude of acceleration which the engine is to perform. Then, the valve opening period TMA of the fuel injection valves 6 is calculated from the aforegiven equation (3), at the step 13. In the equation (3), the values of the terms KAST, KTWT and TV are updated each time a pulse of the TDC signal is inputted to the ECU, as previously noted. At the step 14, the fuel injection valves 6 is actuated to open for the valve opening period TMA calculated at the step 13. Each time the step 14 is executed, 1 is subtracted from the stored value of the pulse number NACCA, at the step 15. When the answer to the question at the step 11 is negative, the values of the flag signals NATDC, NFLG are both set to 1, at the steps 16 and 17, and at the same time, the stored value of the pulse number NACCA is set to the initial value NAA, at the step 18. On the other hand, if the answer to the question at the step 9 is negative, that is, if the throttle valve opening variation $\Delta\theta$A is determined to be smaller than the predetermined value GA+, it is then determined at the step 19 whether or not the value of the flag signal NFLG indicative of fulfillment of the predetermined asynchronous accelerating control condition is 0. If the answer is yes, it is further determined at the step 20 whether or not the stored value of the pulse number NACCA in the present loop is larger than 0, and also at the step 21 whether or not the throttle valve opening variation $\Delta\theta$A is smaller than the predetermined negative value GA− for determining fulfillment of a decelerating condition of the engine. If the answer to the question of the step 21 is no, that is, if the variation $\Delta\theta$A is larger than the negative predetermined value GA−, a basic value TiA of the asynchronous accelerating control determined in the preceding loop is applied for calculation of the valve opening period TMA, at the steps 22 and 13, to carry out fuel injection according to the asynchronous accelerating control in the manner described above (step 14), and simultaneously 1 is subtracted from the stored value of the pulse number NACCA at the step 15. If the answer to the question at the step 20 is negative and at the same time the answer to the question at the step 21 is affirmative, the values of the flag signals NATDC, NFLG are both set to 1, at the steps 23 and 24, accompanied by setting the stored value of the pulse number NACCA to the initial value NAA at the step 25. As previously stated, if the accelerating fuel increase is effected only when the throttle valve opening variation $\Delta\theta A$ is larger than the predetermined positive value GA+, the fuel increasing action can be interrupted before fuel injections corresponding in number to the predetermined number of fuel increasing pulses are finished, in the latter half of an accelerating action of the engine wherein the rate of change of the throttle valve opening decreases while the valve opening is increasing or the variation $\Delta\theta A$ becomes zero or negative, resulting in deterioration of the driveability of the engine. To eliminate this disadvantage, according to the invention, as stated above, even if the throttle valve opening variation $\Delta\theta A$ becomes equal to the predetermined value GA+ or smaller than same, the asynchronous fuel increasing action is continued so far as the variation $\Delta\theta A$ remains equal to or larger than the predetermined negative value GA−, that is, except when the driver wants to decelerate the engine, thereby enabling continued execution of an accelerating fuel injections corresponding to the predetermined number of driving pulses to improve the driveability of the engine at acceleration.

Figure 8:
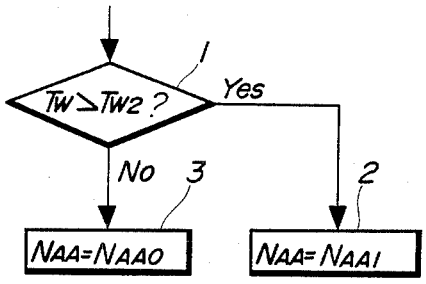
FIG. 8 is a flow chart showing a subroutine for determining the number of fuel increasing pulses NAA indicative of the number of times of consecutive fuel injections according to the engine rotation-asynchronous accelerating control, as a function of the engine cooling water temperature TW.

Further, the lower the engine temperature, the larger the fuel increasing quantity required for the engine at sudden acceleration of same becomes. In view of this, according to the invention, the initial value NAA of the asynchronous acceleration fuel increasing pulses is set as a function of the engine temperature, so as to carry out accelerating control in a manner more suited for operating conditions of the engine, ensuring further improvement of the driveability and positive starting of the engine. FIG. 8 shows an exemplary manner of setting the initial value NAA in two steps in dependence on the engine temperature TW. It is determined at the step 1 whether or not the engine cooling water temperature TW is higher than a predetermined value TW2 (e.g. 30° C.). If the answer is yes, the initial value NAA is set to a lower value NAA1 (e.g. 4) at the step 2, while if the answer is no, the same value NAA is set to a higher value NAA0 (e.g. 10), at the step 3. The above predetermined temperature value TW2 is set at a value within a range of −30° C. to +70° C. Alternatively of the manner of setting the value NAA stepwise, i.e. to a plurality of different values, the value NAA may be varied steplessly with a change in the engine cooling water temperature TW.

Figure 9:
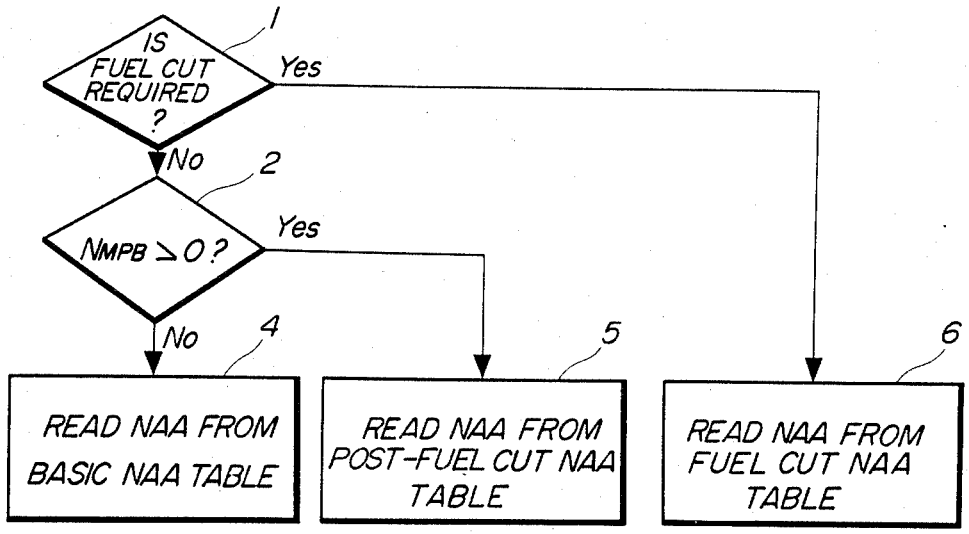
FIG. 9 is a flow chart showing a subroutine for determining the number of fuel increasing pulses NAA, executed at acceleration of the engine after termination of a fuel cut operation.
Figure 10:
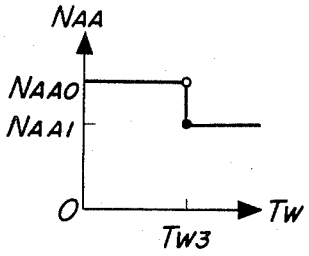
FIG. 10 is a graph showing a table of the relationship between the number of fuel increasing pulses NAA applied at normal acceleration of the engine after the lapse of a predetermined period of time from generation of a first TDC signal pulse immediately after termination of a fuel cut operation and the engine cooling water temperature TW.
Figure 11:
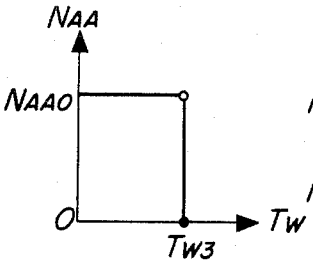
FIG. 11 is a graph showing a table of the relationship between the number of fuel increasing pulses NAA applied at acceleration before the lapse of the predetermined period of time from generation of a first TDC signal pulse immediately after termination of a fuel cut operation and the engine cooling water temperature TW.

Further, according to the invention, in addition to the above described manners of control, the initial value NAA of pulses of the above fuel increasing signal is set to different values depending upon whether the engine is in a fuel cut effecting condition or in a condition immediately after a fuel cut operation. FIG. 9 shows an example of the manner of setting the initial value NAA depending upon the fuel cut operation or post-fuel cut operation of the engine. First, it is determined at the step 1 whether or not the engine is in a fuel cut effecting condition, each time a pulse of the TDC signal is inputted to the ECU 5. If the answer is no, that is, if the engine is not in the fuel cut effecting condition, a further determination is made as to whether or not a predetermined value NMPB which is set to a value equal to the number of the engine cylinders (e.g. 4) is larger than 0, at the step 2. The above predetermined value NMPB is reduced by 1 each time a pulse of the TDC signal is inputted to the ECU 5, and is reduced to 0 when all the cylinders of the engine are each supplied with one batch of fuel after termination of a fuel cut operation. When the predetermined value NMPB is determined to be 0 at the step 2, a value of the initial pulse number NAA is determined from a basic NAA table, which corresponds to the actual engine cooling water temperature TW, at the step 4, and when it is determined that the engine is in an accelerating condition, between the time of generation of a present pulse of the TDC signal and the time of generation of the next pulse of same, fuel injections according to the asynchronous accelerating control are effected a number of times equal to the initial value NAA thus determined. FIG. 10 shows an example of the above basic NAA table. According to this table, when the engine water temperature TW is lower than a predetermined value TW3 (e.g. 20° C.), the initial pulse number NAA is set to a predetermined value NAA0 (e.g. 10), while when the water temperature TW is higher than the predetermined value TW3, the initial value NAA is set to another predetermined value NAA1 (e.g. 4). The above predetermined temperature TW3 is set at a value within a range of −30° C. to +70° C. On the other hand, if the answer to the question of the step 2 is affirmative, that is, before four pulses of the TDC signal are inputted to the ECU 5 after termination of a fuel cut operation, a value of the initial value NAA corresponding to the engine water temperature TW is now determined from a post-fuel cut NAA table. FIG. 11 shows an example of the post-fuel cut NAA table. According to the table, the initial value NAA is set to the aforementioned predetermined value NAAO (e.g. 10) when the engine water temperature TW is lower than the predetermined value TW3, and set to 0 when the temperature TW is higher than the latter. The reason for setting the initial value NAA to 0 when the engine water temperature TW is above the predetermined value TW3 to prohibit the asynchronous accelerating control is that immediately after termination of a fuel cut operation, the aforementioned after-fuel cut fuel increasing coefficient KAFC, whose value is determined by a predetermined subroutine, is applied for the TDC signal-synchronous basic control for a period of time corresponding to the predetermined value NMPB for prevention of engine stall, etc., but if on such occasion a further fuel increase according to the asynchronous accelerating control is applied at the same time, the resultant fuel injection quantity will be undesirably excessive. Alternatively of completely prohibiting the fuel increase according to the asynchronous accelerating control immediately after termination of a fuel cut operation as described above, the same control may be applied on such an occasion to increase the fuel supply quantity by a slight amount so as to compensate for variations in the operating characteristics of the engine.

Figure 12:
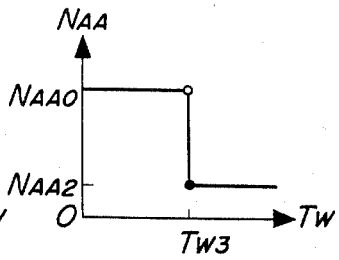
FIG. 12 is a graph showing a table of the relationship between the number of fuel increasing pulses NAA applied at acceleration before generation of a first TDC signal pulse from the time of detection of an operating condition of the engine requiring interruption of a fuel cut operation and the engine cooling water temperature TW.

On the other hand, when the engine cooling water temperature TW is lower than the predetermined value TW3, such as in cold weather, wherein the engine requires rather a great amount of fuel such as in acceleration, the initial value NAA of fuel increasing pulses is set to the predetermined value NAAO (e.g. 10) according to the table of FIG. 9. Reverting now to the aforementioned step 1 of FIG. 9, if the engine is determined to be in the fuel cut effecting condition, the step 6 is then executed to determine a value of the initial value NAA corresponding to the engine water temperature TW, from a fuel cut NAA table. FIG. 12 shows an example of this fuel cut NAA table, the initial value NAA is set to the predetermined value NAA0 (e.g. 10) when the engine water temperature TW is below the predetermined value TW3, and set to a predetermined value NAA2 (e.g. 2) when the engine water temperature TW is above the predetermined value TW3.

What is claimed is:

1. A method for electronically controlling a fuel injection device for injecting fuel into an internal combustion engine, so as to supply a required quantity of fuel to said engine when it is accelerating, the method comprising the steps of:

(1) determining whether or not said engine is operating in a predetermined accelerating condition, each time a pulse of a control signal is generated with a predetermined constant pulse repetition period and independently of rotation of said engine;

(2) determining whether or not said engine is operating in a predetermined decelerating condition each time a pulse of said control signal is generated;

(3) determining whether or not said engine is in an operating condition requiring cutting off the fuel supply to said engine and also whether or not said engine is in an operating condition requiring interruption of said cutting-off of the fuel supply;

(4) determining whether or not a predetermined period of time has elapsed from the time said engine is determined to be in said operating condition requiring interruption of said cutting-off of the fuel supply;

(5) actuating said fuel injection device to effect fuel injections consecutively into said engine a predetermined number of times in synchronism with generation of pulses of said control signal, when it is determined in said step (1) that said engine is operating in said predetermined accelerating condition;

(6) setting the value of said predetermined number of times in said step (5) to different values between before the lapse of said predetermined period of time and after the lapse thereof; and (7) interrupting said consecutive fuel injections of said step (5), when it is determined in said step (2) that said engine is operating in said predetermined decelerating condition before said predetermined number of times of consecutive fuel injections are completed, while continuing said consecutive fuel injections of said step (5) until said predetermined number of times are reached, so long at it is determined in said step (2) that said engine is not operating in said predetermined decelerating condition.

2. A method as claimed in claim 1, including the step of determining whether or not said engine is operating in a normal operating condtion other than said predetermined accelerating condition and said predetermined decelerating condition, and wherein said consecutive fuel injections of said step (3) are continued until said predetermined number of times are reached even when it is determined that said engine is operating in said normal operating condition before said predetermined number of times of consecutive fuel injections are completed.

3. A method as claimed in claim 1, including the step of setting a quantity of fuel being injected per each of said predetermined number of times in said step (3) in dependence on the magnitude of acceleration required for said engine to perform.

4. A method as claimed in claim 3, wherein said engine includes an intake passage and a throttle valve arranged in said intake passage, said magnitude of acceleration being determined by detecting the rate of change of the valve opening of said throttle valve.

5. A method as claimed in claim 4, wherein said engine is determined to be in said predetermined accelerating condition when the rate of change of the valve opening of said throttle valve assumes a value larger than a first predetermined value while the valve opening is increasing, and determined to be in said predetermined decelerating condition when the rate of change of the valve opening of said throttle valve is larger than a second predetermined value while the valve opening is decreasing.

6. A method as claimed in claim 1, including the step of setting the value of said predetermined number of times in said step (3) in dependence on the temperature of said engine.

7. A method as claimed in claim 6, wherein the value of said predetermined number of times in said step (3) is increased as the temperature of said engine decreases, when the temperature of said engine is lower than a predetermined value.

8. A method as claimed in claim 1, wherein before the lapse of said predetermined period of time the value of said predetermined number of times in said step (3) is set to a value fewer than a value after the lapse of said predetermined period of time.

9. A method as claimed in claim 1, including the step of prohibiting said consecutive fuel injections in said step (3) when the temperature of said engine is higher than a predetermined value.

10. A method as claimed in claim 1, including the step of prohibiting said consecutive fuel injections in said step (3) when the rotational speed of said engine is higher than a predetermined value.

11. A method as claimed in claim 1, including the steps of setting a quantity of fuel being injected into said engine in dependence on operating conditions of said engine, each time a pulse of a signal indicative of a predetermined crank angle of said engine is generated, and actuating said fuel injection device to inject said quantity of fuel thus set into said engine in synchronism with generation of pulses of said signal indicative of said predetermined crank angle of said engine.

12. A method for electronically controlling a fuel injection device for injecting fuel into an internal combustion engine, so as to supply a required quantity of fuel to said engine when it is accelerating, the method comprising the steps of:

(1) determining whether or not said engine is operating in a predetermined accelerating condition, each time a pulse of a first control signal is generated with a predetermined constant pulse repetition period and independently of rotation of said engine;

(2) determining whether or not said engine is operating in a predetermined decelerating condition each time a pulse of said first control signal is generated;

(3) determining whether or not said engine is operating in a normal operating condition other than said predetermined accelerating condition and said predetermined decelerating condition;

(4) determining whether or not said engine is in an operating condition requiring cutting off the fuel supply to said engine;

(5) determining whether or not said engine is in an operating condition requiring interruption of said cutting-off of the fuel supply;

(6) determining whether or not a predetermined period of time has elapsed from the time said engine is determined to be in said operating condition requiring interruption of said cutting-off of the fuel supply;

(7) setting a quantity of fuel being injected into said engine in dependence on operating conditions of said engine, each time a pulse of a second control signal is generated;

(8) actuating said fuel injection device to inject said quantity of fuel thus set into said engine in synchronism with generation of pulses of said second control signal;

(9) increasing said quantity of fuel by a predetermined amount when it is determined in said step (5) that said engine is in said operating condition requiring interruption of said cutting-off of the fuel supply;

(10) actuating said fuel injection device to effect fuel injections consecutively into said engine a predetermined number of times in synchronism with generation of pulses of said first control signal, when it is determined in said step (1) that said engine is operating in said predetermined accelerating condition;

(11) interrupting said consecutive fuel injections of said step (10), when it is determined in said step (2) that said engine is operating in said predetermined decelerating condition before said predetermined number of times of consecutive fuel injections are completed, while continuing said consecutive fuel injections of said step (10) until said predetermined number of times are reached, so long as it is determined in said step (2) that said engine is not operating in said predetermined decelerating condition or it is determined in said step (3) that said engine is operating in said normal operating condition; and

(12) before the lapse of said predetermined period of time, setting the value of said predetermined number of times in said step (10) to a value fewer than a value after the lapse of said pedetermined period of time.

13. A mehtod as claimed in claim 12, including the step of setting a quantity of fuel being injected per each of said predetermined number of times in said step (10) in dependence on the magnitude of acceleration required for said engine to perform.

14. A method as claimed in claim 13, wherein said engine includes an intake passage and a throttle valve arranged in said intake passage, said magnitude of acceleration being determined by detecting the rate of change of the valve opening of said throttle valve.

15. A method as claimed in claim 12, including the step of setting the value of said predetermined number of times in said step (10) in dependence on the temperature of said engine.

16. The method as claimed in claim 12, including the step of prohibiting said consecutive fuel injections in said step (10) when the temperature of said engine is higher than a predetermined value.

17. A method as claimed in claim 12, including the step of prohibiting said consecutive fuel injections in said step (10) when the rotational speed of said engine is higher than a predetermined value.

* * * * *